US009614330B2

(12) United States Patent
Mashiki

(10) Patent No.: US 9,614,330 B2
(45) Date of Patent: Apr. 4, 2017

(54) RELAY CONNECTOR

(71) Applicant: KYOCERA Document Solutions Inc., Osaka-shi, Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/784,145

(22) PCT Filed: Jan. 26, 2015

(86) PCT No.: PCT/JP2015/052009
§ 371 (c)(1),
(2) Date: Oct. 13, 2015

(87) PCT Pub. No.: WO2015/115361
PCT Pub. Date: Aug. 6, 2015

(65) Prior Publication Data

US 2016/0036168 A1 Feb. 4, 2016

(30) Foreign Application Priority Data

Jan. 29, 2014 (JP) ..... 2014-014656

(51) Int. Cl.

| | |
|---|---|
| ***H01R 13/66*** | (2006.01) |
| ***H01R 13/6581*** | (2011.01) |
| ***H01R 13/719*** | (2011.01) |
| ***H01R 31/06*** | (2006.01) |
| ***H01F 27/28*** | (2006.01) |
| ***H01F 27/255*** | (2006.01) |
| ***H01F 27/26*** | (2006.01) |

(52) U.S. Cl.
CPC ..... *H01R 13/6581* (2013.01); *H01F 27/255* (2013.01); *H01F 27/263* (2013.01); *H01F 27/2895* (2013.01); *H01R 13/6633* (2013.01); *H01R 13/719* (2013.01); *H01R 31/06* (2013.01)

(58) Field of Classification Search
CPC ..... H01R 13/719; H01R 13/7193; H01R 13/6633; H01R 13/6581; H01R 31/06; H01F 27/263; H01F 27/255; H01F 27/2895
USPC ..... 439/55, 607.01, 620.01, 620.05
See application file for complete search history.

(56) References Cited

U.S. PATENT DOCUMENTS 5,346,410 A 9/1994 Moore, Jr.

FOREIGN PATENT DOCUMENTS

| | | |
|---|---|---|
| JP | 5-97075 | 12/1993 |
| JP | 6-333746 | 12/1994 |
| JP | 7-508130 | 9/1995 |
| JP | 10-144407 | 5/1998 |
| JP | 2005-123266 | 5/2005 |

OTHER PUBLICATIONS

International Search Report, (Mar. 31, 2015).

*Primary Examiner* — Khiem Nguyen
(74) *Attorney, Agent, or Firm* — Gerald E. Hespos; Michael J. Porco; Matthew T. Hespos

(57) ABSTRACT

A relay connector (1) includes: a first input/output unit (11) to which a cable connector (92) connected to one end of a cable (91) is detachably connected; a second input/output unit (12) that is detachably connected to a board connector (93) provided in a board (94) to which the cable connector (92) can be detachably connected, and that is electrically connected to the first input/output unit (11); and a core (13) that suppress noise radiated by a signal flowing between the first input/output unit (11) and the second input/output unit (12).

5 Claims, 4 Drawing Sheets

RELAY CONNECTOR

TECHNICAL FIELD

The present invention relates to a relay connector that suppresses noise radiated by current flowing through a cable.

BACKGROUND ART

From the past, it is known that noise is radiated when signals flow through a cable connected to a board of an electronic apparatus. Thus, as countermeasures against so-called electromagnetic interference (EMI) for suppressing the noise, a method of attaching a core to a cable by, for example, inserting a cable into a tubular core or winding a cable around a bobbin-shaped core has been known.

Moreover, as disclosed in Japanese Unexamined Patent Publication No. H10-144407 and Japanese Unexamined Patent Publication No. 2005-123266, for example, a technique of integrating a core and a cable connector with a cable interposed to reduce the attachment space of the core in an electronic apparatus.

The frequency of radiated noise is different depending on the frequency of signals flowing through a cable. Thus, when the conventional technique is employed, it is necessary to adjust the frequency of noise to be suppressed by the core in advance by changing the type of the core attached to a cable or changing the number of turns of the cable wound around the cable depending on the specification of signals flowing through the cable. However, due to the influence of noise propagating from peripheral devices connected to an electronic apparatus after shipment, the frequency of noise radiated from the cable may be different from the frequency assumed in advance. In this case, it is necessary to re-adjust the frequency of noise to be suppressed by the core.

According to the technique disclosed in Japanese Unexamined Patent Publication No. H10-144407 and Japanese Unexamined Patent Publication No. 2005-123266, when the need to re-adjust the frequency of noise to be suppressed by the core occurs, it is necessary to change the type of the core by disassembling the cable connector because the core is included in the cable connector. Alternatively, it is necessary to replace the cable itself with a cable having a cable connector in which a different type of core is included. Moreover, since it is difficult to change the length of the cable which has been included in the product, it is difficult to perform the re-adjustment by changing the number of turns of the cable wound around the core.

An object of the present invention is to provide a relay connector capable of re-easily adjusting the frequency of noise to be suppressed.

SUMMARY OF THE INVENTION

A relay connector according to an aspect of the present invention includes: a first input/output unit to which a cable connector connected to one end of a cable is detachably connected; a second input/output unit that is detachably connected to a board connector provided in a board to which the cable connector can be detachably connected, and that is electrically connected to the first input/output unit; and a core that suppress noise radiated by a signal flowing between the first input/output unit and the second input/output unit.

According to the present invention, a relay connector capable of re-easily adjusting the frequency of noise to be suppressed is provided.

DESCRIPTION OF EMBODIMENTS

First Embodiment

Figure 1A:
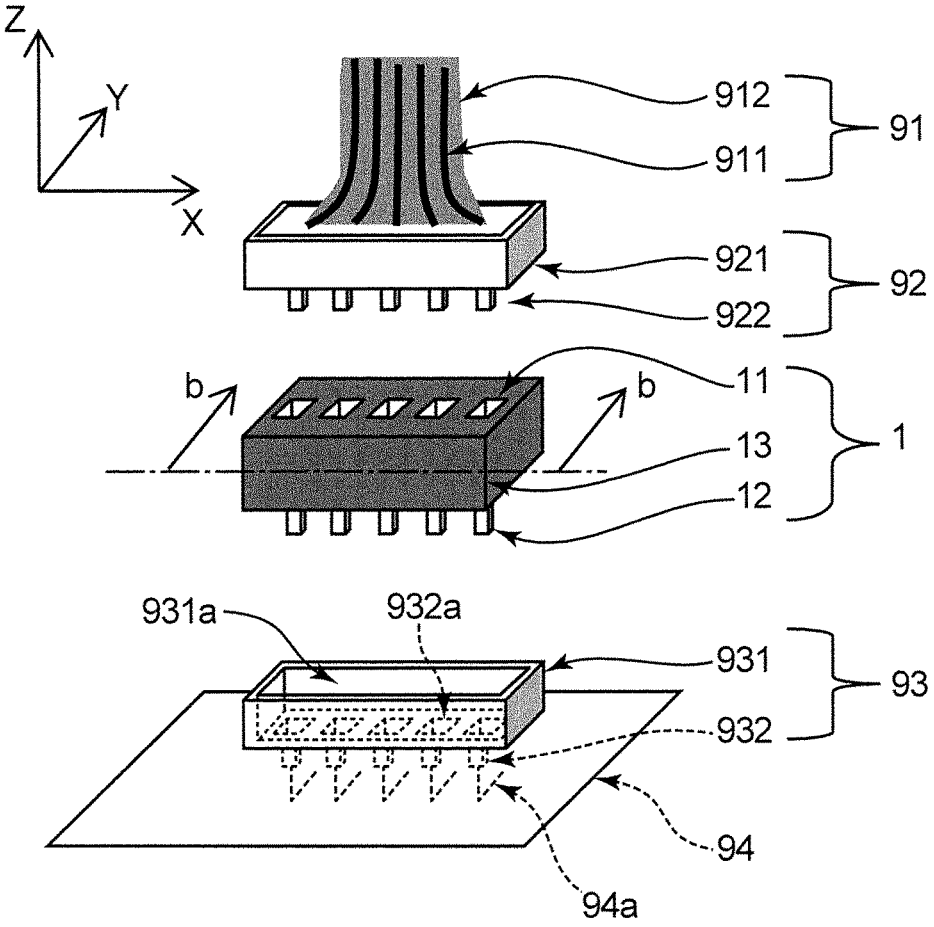
FIG. 1A is a perspective view of a relay connector according to a first embodiment of the present invention.
Figure 1B:
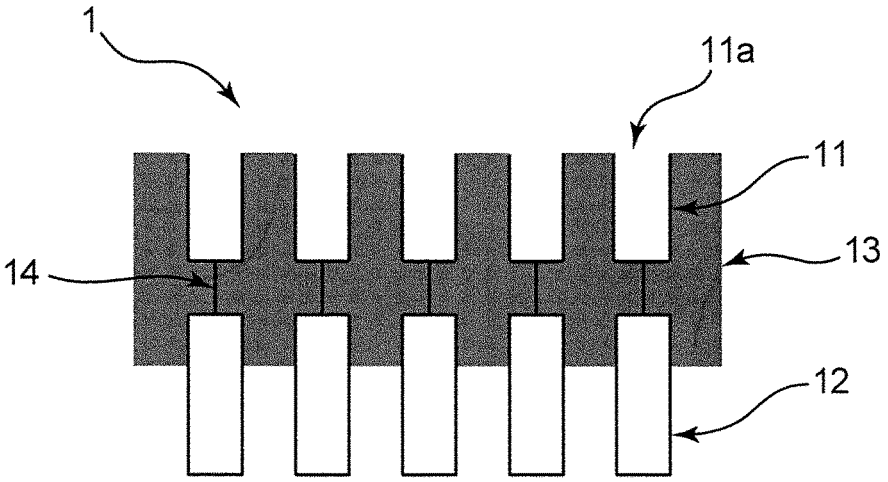
FIG. 1B is a cross-sectional view, along the direction b-b, of the relay connector according to the first embodiment of the present invention.

Hereinafter, a relay connector according to a first embodiment of the present invention will be described with reference to the drawings. FIG. 1A is a perspective view of a relay connector according to a first embodiment of the present invention. FIG. 1B is a cross-sectional view, along the direction b-b, of the relay connector according to the first embodiment of the present invention. As illustrated in FIG. 1A, a cable 91 includes five signal lines 911 and a cladding 912 that covers the five signal lines 911, for example. A cable connector 92 is connected to one end of the cable 91.

The cable connector 92 includes a body portion 921 and five male terminals 922. The body portion 921 is formed in a rectangular parallelepiped form. The male terminals 922 are pin-shaped terminals that protrude from a bottom surface of the body portion 921. The five male terminals 922 are arranged in a line in a longitudinal direction (an X-direction illustrated in FIG. 1) on the bottom surface of the body portion 921 at a predetermined interval therebetween. The five signal lines 911 of the cable 91 are inserted in an insertion path (not illustrated) having an opening on an upper surface of the body portion 921 and are connected to one set of ends (not illustrated) of the five male terminals 922 inside the body portion 921.

Hereinafter, a longitudinal direction of the upper and bottom surfaces of the body portion 921 will be denoted by the X-direction. The lateral direction of the upper and bottom surfaces of the body portion 921 will be denoted by a Y-direction. A height direction of the body portion 921 will be denoted by a Z-direction.

On the other hand, a board connector 93 is provided in a board 94 of an electronic apparatus such as an image forming apparatus such as a copying machine, a printer, a facsimile apparatus, or a multifunctional peripheral, a mobile phone, a game machine, or the like in order to detachably connect the cable connector 92.

The board connector 93 includes a body portion 931 and five female terminals 932, for example.

The body portion 931 is formed in a box form which has an open upper surface and a hollow portion 931*a* having a rectangular parallelepiped form. The length in the X-direction of the hollow portion 931*a* is larger than the length in the X-direction of the body portion 921 of the cable connector 92. The length in the Y-direction of the hollow portion 931*a* is larger than the length in the Y-direction of the body portion 921 of the cable connector 92. The length in the Z-direction of the hollow portion 931*a* is larger than the length in the Z-direction of the body portion 921 of the cable connector 92.

The female terminal 932 is a depressed terminal having an opening 932*a* on an upper surface (the surface in contact with the bottom surface of the hollow portion 931*a*) of the bottom surface portion of the body portion 931. The five openings 932*a* are arranged in a line in the X-direction at the same interval as the interval between the male terminals 922 of the cable connector 92. The length (depth) in the Z-direction of the female terminal 932 is the same as the length of a portion of the male terminal 922 of the cable connector 92 protruding in the Z-direction from the bottom surface of the body portion 921. In this manner, the five female terminals 932 are configured to engage with the five male terminals 922 of the cable connector 92. One end on the opposite side from the opening 932*a* of the female terminal 932 is connected to the signal line 94*a* provided in the board 94.

Thus, by engaging the five male terminals 922 of the cable connector 92 with the five female terminals 932 of the board connector 93, the cable connector 92 can be detachably connected to the board connector 93. Moreover, when the cable connector 92 is connected to the board connector 93, the cable connector 92 can be accommodated in the hollow portion 931*a* of the body portion 931.

As illustrated in FIGS. 1A and 1B, the relay connector 1 according to the first embodiment of the present invention includes five female terminals 11 (first input/output units) corresponding to the five male terminals 922 of the cable connector 92, five male terminals 12 (second input/output units), and a core 13 formed in a rectangular parallelepiped form.

The female terminal 11 is a depressed terminal having an opening 11*a* on an upper surface (front surface) of the core 13. The five openings 11*a* are arranged in a line in the X-direction at the same interval as the interval between the male terminals 922 of the cable connector 92. The length (depth) in the Z-direction of the female terminal 11 is the same as the length of a portion of the male terminal 922 of the cable connector 92 protruding in the Z-direction from the bottom surface of the body portion 921. In this manner, the five female terminals 11 are configured to engage with the five male terminals 922 of the cable connector 92.

Thus, by engaging the five male terminals 922 of the cable connector 92 with the five female terminals 11, the cable connector 92 can be detachably connected to the five female terminals 11. Moreover, when the cable connector 92 is connected to the five female terminals 11, the bottom surface of the cable connector 92 can be brought into contact with the upper surface of the core 13.

The male terminals 12 are pin-shaped terminals that protrude from the bottom surface of the core 13. The five male terminals 12 are arranged in a line in the X-direction at the same interval as the interval between the female terminals 932 of the board connector 93. The length of a portion of the male terminal 12 protruding in the Z-direction from the bottom surface of the core 13 is the same as the length (depth) in the Z-direction of the female terminal 932 of the board connector 93. In this manner, the five male terminals 12 are configured to engage with the five female terminals 932 of the board connector 93.

Thus, by engaging the five male terminals 12 with the five female terminals 932 of the board connector 93, the five male terminals 12 can be detachably connected to the board connector 93. Moreover, when the five male terminals 12 are connected to the board connector 93, the upper surface (the surface in contact with the bottom surface of the hollow portion 931*a*) of the bottom surface portion of the body portion 931 can be brought into contact with the bottom surface of the core 13.

As illustrated in FIG. 1B, inside the core 13, the female terminals 11 and the male terminals 12 are electrically connected using the signal lines 14. That is, by engaging the male terminal 922 of the cable connector 92 with the female terminal 11 and engaging the male terminal 12 with the female terminal 932 of the board connector 93, it is possible to allow signals to flow from the cable 91 to the board 94 or from the board 94 to the cable 91 through the female terminal 11, the signal line 14, and the male terminal 12.

The core 13 is formed of a magnetic material such as ferrite and a resin, for example, and as illustrated in FIG. 1B, and is configured to cover a portion of the five female terminals 11 and the five male terminals 12. In this way, the core 13 suppresses noise radiated from the female terminal 11, the male terminal 12, or the signal line 14 by the signals flowing between the female terminal 11 and the male terminal 12 when signals are drawn from the cable 91 to the female terminal 11 or from the board 94 to the male terminal 12.

As described above, according to the configuration of the first embodiment, it is possible to detachably connect the five female terminals 11 to the cable connector 92 and to detachably connect the five male terminals 12 to the board connector 93. Thus, it is possible to easily attach the relay connector 1 between the cable connector 92 and the board connector 93. After the relay connector 1 is attached, when signals are input and output between the board 94 and the cable 91, the noise radiated from the signals drawn from the cable 91 or the board 94 and flowing between the female terminal 11 and the male terminal 12 can be suppressed by the core 13.

By doing so, when different types of cores are provided and a plurality of types of relay connectors 1 are prepared, by replacing the relay connector 1 attached between the cable connector 92 and the board connector 93, it is possible to easily readjust the frequency of noise to be suppressed.

Moreover, when the relay connector 1 is attached, the male terminal 922 of the cable connector 92 is connected so as to enter into the core 13. Moreover, the bottom surface of the cable connector 92 makes contact with the upper surface of the core 13, and the upper surface (the surface in contact with the bottom surface of the hollow portion 931*a*) of the bottom surface portion of the body portion 931 of the board connector 93 makes contact with the bottom surface of the core 13. That is, no gap is present between the cable connector 92 and the relay connector 1 and between the relay connector 1 and the board connector 93. In this way, it is possible to reduce the space required for attachment of the relay connector 1.

Moreover, after the relay connector 1 is attached, when signals are input and output between the board 94 and the cable 91, no gap is present between the cable connector 92 and the relay connector 1. Thus, it is possible to reduce the possibility that the noise radiated via the female terminal 11 engaged with the male terminal 922 from the male terminal 922 of the cable connector 92 propagates to the outside without via the core 13.

The relay connector 1 is not limited to the configuration illustrated in FIG. 1B. The relay connector may be formed by bringing the lower end of the female terminal 11 into contact with the upper end of the male terminal 12 or integrally form the female terminal 11 and the male terminal 12 so that the female terminal 11 and the male terminal 12 are electrically connected without forming the signal line 14.

Moreover, the number of signal lines 911 provided in the cable 91 is not limited to 5. The number of male terminals 922 of the cable connector 92 and the number of female terminals 932 of the board connector 93 may be different according to the number of signal lines 911 provided in the cable 91. In line with this, the number of female terminals 11 and male terminals 12 provided in the core 13 may be changed appropriately.

Moreover, the cable connector 92 may include a female terminal instead of the male terminal 922, and in line with this, the board connector 93 may include a male terminal instead of the female terminal 932. In this case, a male terminal (first input/output unit) that protrudes from the upper surface of the core 13 of the relay connector 1 and engages with the female terminal of the cable connector 92 may be provided. Moreover, a female terminal (second input/output unit) that has an opening on the bottom surface of the core 13 and engages with the male terminal of the board connector 93 may be provided. That is, the relay connector 1 illustrated in FIGS. 1A and 1B may be inverted upside-down so that the male terminal 12 after inversion engages with the female terminal of the cable connector and the female terminal 11 after inversion engages with the male terminal of the board connector. Moreover, the relay connector according to an embodiment of the present invention may be configured such that the male terminal 12 after inversion is used as the first input/output unit and the female terminal 11 after inversion is used as the second input/output unit.

Second Embodiment

Figure 2:
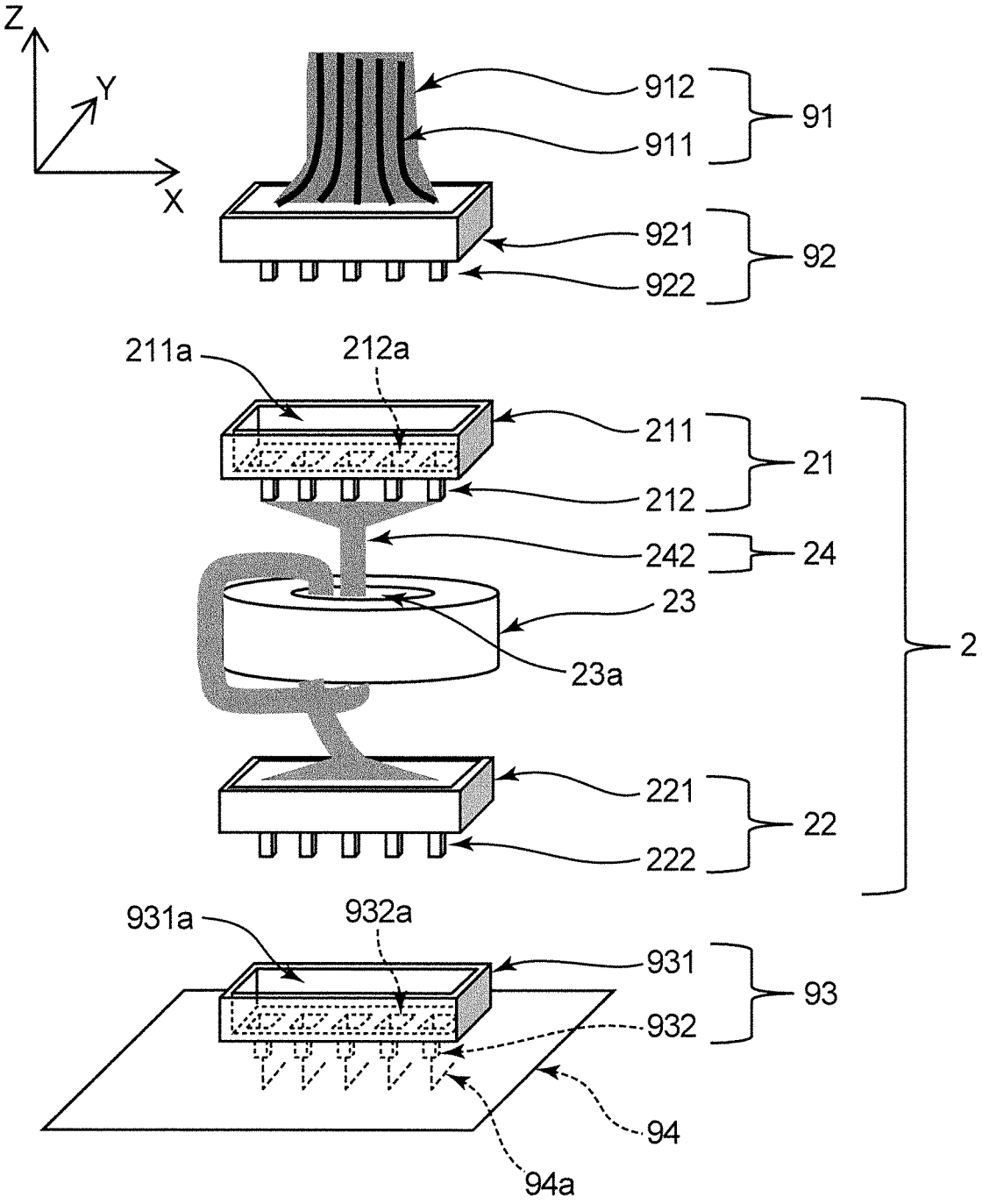
FIG. 2 is a perspective view of a relay connector according to a second embodiment of the present invention.

Next, a relay connector according to a second embodiment of the present invention will be described based on the drawings. FIG. 2 is a perspective view illustrating the relay connector according to the second embodiment of the present invention. As illustrated in FIG. 2, a relay connector 2 according to the second embodiment of the present invention includes an extension cable 24, a first connector 21 (first input/output unit), a second connector 22 (second input/output unit), and a core 23.

The extension cable 24 has the same configuration as the cable 91 and includes five signal lines (not illustrated) and a cladding 242 that covers the five signal lines.

The first connector 21 includes a body portion 211 and five female terminals 212 corresponding to the five male terminals 922 of the cable connector 92.

The body portion 211 is formed in a box form which has an open upper surface and a hollow portion 211*a* having a rectangular parallelepiped form. The length in the X-direction of the hollow portion 211*a* is larger than the length in the X-direction of the body portion 921 of the cable connector 92. The length in the Y-direction of the hollow portion 211*a* is larger than the length in the Y-direction of the body portion 921 of the cable connector 92. The length in the Z-direction of the hollow portion 211*a* is larger than the length in the Z-direction of the body portion 921 of the cable connector 92.

The female terminal 212 is a depressed terminal having an opening 212*a* on an upper surface (the surface in contact with the bottom surface of the hollow portion 211*a*) of the bottom surface portion of the body portion 211. The five openings 212*a* are arranged in a line in the X-direction at the same interval as the interval between the male terminals 922 of the cable connector 92. The length (depth) in the Z-direction of the female terminal 212 is the same as the length of a portion of the male terminal 922 of the cable connector 92 protruding in the Z-direction from the bottom surface of the body portion 921. In this manner, the five female terminals 212 are configured to engage with the five male terminals 922 of the cable connector 92. One end on the opposite side from the opening 212*a* of the female terminal 212 is connected to one end of a signal line (not illustrated) of the extension cable 24.

That is, by engaging the five male terminals 922 of the cable connector 92 with the five female terminals 212 of the first connector 21, the cable connector 92 can be detachably connected to the first connector 21. Moreover, when the cable connector 92 is connected to the first connector 21, the cable connector 92 can be accommodated in the hollow portion 211*a* of the body portion 211.

The second connector 22 includes a body portion 221 and five male terminals 222. The body portion 221 is formed in a rectangular parallelepiped form.

The male terminals 222 are pin-shaped terminals that protrude from the bottom surface of the body portion 221. The five male terminals 222 are arranged in a line in the X-direction at the same interval as the interval between the female terminals 932 of the board connector 93. The length of a portion of the male terminal 222 protruding in the Z-direction from the bottom surface of the body portion 221 is the same as the length (depth) in the Z-direction of the five female terminals 932 of the board connector 93. In this manner, the five male terminals 222 engage with the five female terminals 932 of the board connector 93.

That is, by engaging the five male terminals 222 with the five female terminals 932 of the board connector 93, the second connector 22 can be detachably connected to the board connector 93.

Moreover, five signal lines of the extension cable 24 are inserted in an insertion path (not illustrated) having an opening on the upper surface of the body portion 221 and are connected to one set of ends (not illustrated) of the five male terminals 222 inside the body portion 221. That is, the extension cable 24 has one end connected to the first connector 21 and the other end connected to the second connector 22 whereby the first connector 21 is electrically connected to the second connector 22.

Therefore, by connecting the cable connector 92 to the first connector 21 and connecting the second connector 22 to the board connector 93, it is possible to flow signals from the cable 91 to the board 94 or from the board 94 to the cable 91 through the first connector 21, the extension cable 24, and the second connector 22.

The core 23 is formed of a magnetic material such as ferrite and a resin, for example, in a tubular form (ring form) and has a hollow portion 23*a* (insertion path) through which the extension cable 24 is inserted. The hollow portion 23*a* has a larger size than the area of a side surface (the YZ-plane in FIG. 2) of the first connector 21 or a side surface (the YZ-plane in FIG. 2) of the second connector 22. That is, the hollow portion 23*a* has such a size that the extension cable 24 can be inserted therethrough with the first and second connectors 21 and 22 connected to the extension cable 24.

Thus, after inserting the extension cable 24 through the hollow portion 23*a* of the core 23, by turning the extension cable 24 inserted through the hollow portion 23*a* around the core 23 and inserting the wound extension cable 24 again through the hollow portion 23*a*, the extension cable 24 can be wound around the core 23. The hollow portion 23*a* may have a smaller size than the side surface (the YZ-plane in FIG. 2) of the first connector 21 or the second connector 22. In this case, after inserting the extension cable 24 only through the hollow portion 23*a* and winding the extension cable 24 around the core 23, the first and second connectors 21 and 22 may be connected to the extension cable 24.

In this manner, the core 23 is attached to the extension cable 24. In this way, the core 23 suppresses noise radiated by signals flowing into the extension cable 24 when signals flow from the cable 91 into the first connector 21 via the cable connector 92 or when signals flow from the board 94 into the second connector 22 via the board connector 93.

By inserting the extension cable 24 through the hollow portion 23*a* of the core 23 only once rather than winding the same around the core 23 or by winding the extension cable 24 around the core 23 once or more and changing the number of insertions (turns) of the extension cable 24 through the hollow portion 23*a*, the magnitude of impedance applied to the extension cable 24 can be adjusted by the core 23. In this way, it is possible to adjust the frequency of noise to be suppressed by the core 23.

As described above, according to the configuration of the second embodiment, it is possible to detachably connect the first connector 21 to the cable connector 92 and to detachably connect the second connector 22 to the board connector 93. Thus, it is possible to easily attach the relay connector 2 between the cable connector 92 and the board connector 93. After the relay connector 2 is attached, when signals are input and output between the board 94 and the cable 91, the noise radiated by the signals drawn from the cable 91 or the board 94 and flowing between the first connector 21 and the second connector 22 through the extension cable 24 can be suppressed by the core 23.

Moreover, when an existing cable 91 has no margin in its length and it is difficult to attach a new core to the cable 91 and wind the cable 91 around the core, it is necessary to re-adjust the frequency of noise to be suppressed. In this case, according to the configuration of the second embodiment, by changing the type of the core 23 attached to the extension cable 24 or adjusting the number of turns of the extension cable 24 wound around the core 23 without replacing the existing cable 91, it is possible to easily re-adjust the frequency of noise to be suppressed.

Moreover, the number of signal lines 911 provided in the cable 91 is not limited to 5. The number of male terminals 922 of the cable connector 92 and the number of female terminals 932 of the board connector 93 may be different according to the number of signal lines 911 provided in the cable 91. In line with this, the number of female terminals 212 of the first connector 21, the number of insertion paths of the body portion 221 of the second connector 22, and the number of male terminals 222 of the second connector 22 may be changed appropriately.

Moreover, the cable connector 92 may include a female terminal instead of the male terminal 922, and in line with this, the board connector 93 may include a male terminal instead of the female terminal 932. In this case, the relay connector 2 illustrated in FIG. 2 may be inverted upside-down so that the male terminal 222 of the second connector 22 after inversion engages with the female terminal of the cable connector and the female terminal of the first connector 21 after inversion engages with the male terminal of the board connector. Moreover, the relay connector according to an embodiment of the present invention may be configured such that the second connector 22 after inversion is used as the first connector and the first connector 21 after inversion is used as the second connector.

Figure 3A:
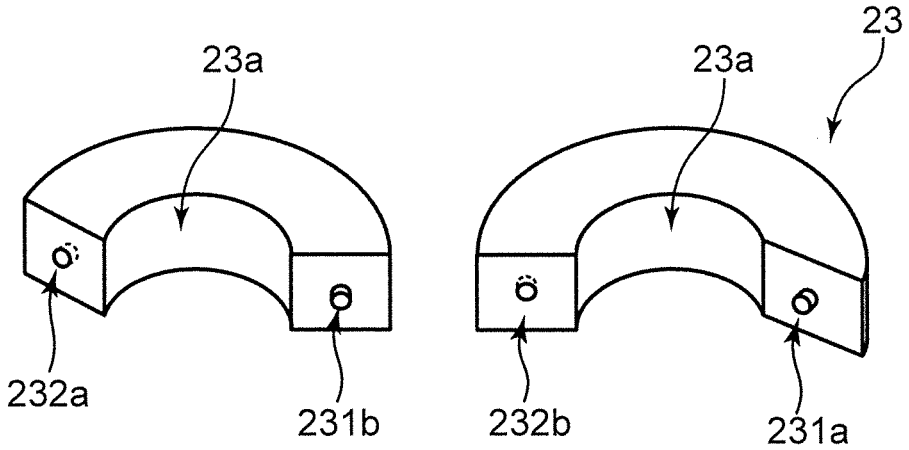
FIG. 3A is a diagram illustrating a core according to a first modified embodiment of the present invention.
Figure 3B:
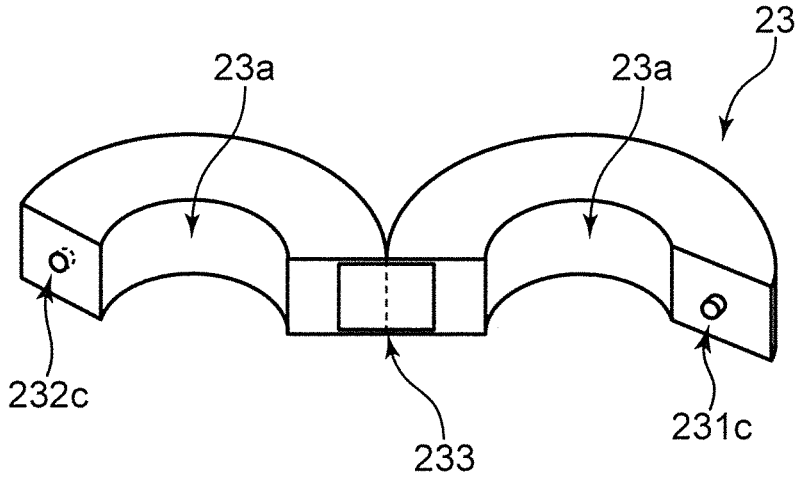
FIG. 3B is a diagram illustrating a core according to a second modified embodiment of the present invention.

The configuration illustrated in FIGS. 1A, 1B, and 2 is an example of the embodiment according to the present invention. For example, the core 23 attached to the extension cable 24 in the second embodiment may be configured as illustrated in FIG. 3A. That is, two sets of engaging projection-recess combinations (a combination of a projection 231*a* and a recess 232*a* and a combination of a projection 231*b* and a recess 232*b*) may be provided so that the core 23 can be divided. Alternatively, as illustrated in FIG. 3B, only one set of engaging projection-recess combinations (a combination of a projection 231*c* and a recess 232*c*) may be provided. Moreover, a sealing member 233 may be bonded so that the core 23 is not divided or a hinge may be provided so that the core 23 can be opened and closed. That is, the core 23 may be configured so as to be removable from the extension cable 24.

In such a case, it is easy to change the type of the core 23 and to change the number of turns of the extension cable 24 wound around the core 23. Moreover, the hollow portion 23*a* of the core 23 may have such a size that the first connector 21 and the second connector 22 cannot be inserted therethrough. By doing so, it is possible to decrease the size of the core 23 and to reduce an attachment space of the relay connector 2.

Figure 4A:
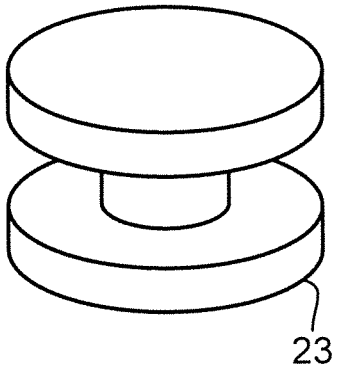
FIG. 4A is a diagram illustrating a core according to a third modified embodiment of the present invention.
Figure 4B:
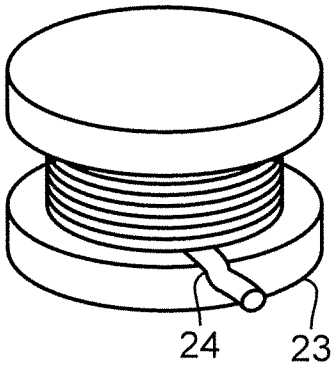
FIG. 4B is a diagram illustrating a state in which the core according to the third modified embodiment of the present invention is attached to an extension cable.

Alternatively, the core 23 is not limited to a tubular form, but the core 23 may be formed in a bobbin form as illustrated in FIG. 4A and may be configured so that the extension cable 24 can be wound around the core 23 as illustrated in FIG. 4B. By doing so, the core 23 may be configured so as to be removable from the extension cable 24.

In this case, it is easy to change the type of the core 23 and to change the number of turns of the extension cable 24 wound around the core 23.

The invention claimed is:

1. A relay connector comprising:

a first input/output unit to which a cable connector connected to one end of a cable is detachably connected;

a second input/output unit that is detachably connected to a board connector provided in a board to which the cable connector can be detachably connected, and that is electrically connected to the first input/output unit; and a core that suppress noise radiated by a signal flowing between the first input/output unit and the second input/output unit, wherein the first input/output unit is a terminal that is provided in the core so as to engage with a terminal of the cable connector, the second input/output unit is a terminal that is provided in the core so as to engage with a terminal of the board connector, and a female terminal of any one of the first input/output unit and the second input/output unit is provided so as to have an opening on a surface of the core.

2. The relay connector according to claim 1, further comprising:

an extension cable that connects the first input/output unit and the second input/output unit, wherein the first input/output unit is a first connector connected to one end of the extension cable, the second input/output unit is a second connector connected to the other end of the extension cable, and the core is attached to the extension cable.

3. The relay connector according to claim 2, wherein the core has an insertion path through which the extension cable is inserted.

4. The relay connector according to claim 2, wherein the core is configured to be removable from the extension cable.

5. The relay connector according to claim 2, wherein the core is formed in a ring shape and has a hollow portion through which the extension cable is inserted, and the extension cable is inserted into the hollow portion and is wound around the core.

* * * * *